United States Patent [19]

Izumida et al.

[11] 4,195,246

[45] Mar. 25, 1980

[54] SUPPORT STRUCTURE FOR DIRECTLY-HEATED CATHODE OF CATHODE RAY TUBE

[75] Inventors: Yukihiro Izumida; Kitaro Sasaki, both of Mobara; Yoshinobu Miyamoto, Chiba, all of Japan

[73] Assignee: Hitachi, Ltd., Japan

[21] Appl. No.: 949,403

[22] Filed: Oct. 10, 1978

[51] Int. Cl.[2] ..... H01J 1/15

[52] U.S. Cl. ..... 313/292; 313/284; 313/345

[58] Field of Search ..... 313/292, 284, 285, 345

[56] References Cited

U.S. PATENT DOCUMENTS

| | | | |
|---|---|---|---|
| 3,814,976 | 6/1974 | Mitobe et al. | 313/346 R X |
| 3,947,715 | 3/1976 | Puhak | 313/346 R X |

OTHER PUBLICATIONS

Japanese Preliminary Publication of Utility Application 52-28867; Published Feb. 24, 1977; 2 pp.

Japanese Preliminary Publication of Patent Application 50-148259; Published Nov. 27, 1975; 3 pp.

*Primary Examiner*—Alfred E. Smith

*Assistant Examiner*—Charles F. Roberts

*Attorney, Agent, or Firm*—Craig and Antonelli

[57] ABSTRACT

There is disclosed a support structure for a directly-heated cathode in a cathode ray tube, for supporting the cathode by fastening the strip leads of the cathode to support rods piercing and rigidly fixed to a base of insulating material through resistance welding. The support rods are provided in their proper positions respectively with protrusions having top plane areas to be contacted with the surfaces of the strip leads and the cathode is supported by fastening the strip leads to the protrusions through resistance welding. The length of the top plane area of the protrusion extending in the direction along the width of the strip lead is 30 to 80% of the size of the width of the strip lead.

3 Claims, 6 Drawing Figures

SUPPORT STRUCTURE FOR DIRECTLY-HEATED CATHODE OF CATHODE RAY TUBE

FIELD OF THE INVENTION

This invention relates to a support structure for the directly-heated cathode of a cathode ray tube, capable of preventing a break from being formed in the welded portion between the strip lead of the directly-heated cathode and the support rod.

DESCRIPTION OF THE PRIOR ART

In FIG. 1 showing an example of a support structure for the directly-heated cathode of a cathode ray tube, an insulating base 1 of glass or ceramic is pierced by support rods 2 of an alloy of Fe—Ni or Co—Ni—Fe. The support rods 2 are rigidly fixed to the insulating base 1. A directly-heated cathode 3 has strip leads 31, intermediate portion 33 and a disc portion 32. The directly-heated cathode 3 is supported by fastening the free ends of the strip leads 31 perpendicularly to the support rods 2 through resistance welding. Carbonate alkaline earth metal 4, such as $BaCO_3$, $SrCO_3$, $CaCO_3$, or their combination is applied onto the disc portion 32 through spraying or electrodeposition. The disc portion 32 is disposed in alignment with the aperture of the first grid of an electron gun (not shown). The carbonate 4 applied to the disc portion 32 is decomposed by heat treatment performed along with the exhuast process of the cathode ray tube to produce an oxide which is made to be, after aging, a good emitter of thermal electrons. Such a directly-heated cathode structure is disclosed in, for example, Japanese Utility Model Application Laid-Open No. 26,867/77. The directly-heated cathode 3 must be heated, in the normal operation of the cathode ray tube, up to 700°-800° C. by a current flowing through it via the support rods 2. Accordingly, the disc portion 32 and the intermediate portions 33, which must be kept at high temperatures during operation, may sometimes be deformed to change the distance between them and the first grid (not shown), so that the brightness in a reproduced picture is changed. In the case of a color picture tube having three directly-heated cathodes in an electron gun, the white balance of a reproduced picture may be lost owing to the deformation since the degrees of the deformations of the directly-heated cathodes are not even. Therefore, for the purpose of avoiding such a drawback, namely reducing the deformation, the directly-heated cathode is usually made of alloy of W—Ni or Mo—Ni containing a very small amount of activating agent, which has a very high mechanical strength even at high temperatures. These alloys, however, have high melting points, which makes resistance welding difficult. Accordingly for attaining a good welding between the strip lead 31 and the support rod 2, it is necessary to supply a heavy welding current or to strongly press the lead 3 to the rod 2.

FIG. 2 perspectively shows the welded portion between the strip lead 31 and the support rod 2 in a conventional support structure for a directly-heated cathode. Resistance welding is performed by cramping the lead 31 and the rod 2 between the welding electrodes 51 and 52 of alloy of Cr—Cu or Ag—W, indicated by dot-and-dashed lines in FIG. 2, and by supplying current between the electrodes 51 and 52 while the lead and rod are pressed to each other. In this welding process, the pressure exerted on the welded pieces by the electrodes 51 and 52 must be comparatively large and the welding current must also be relatively heavy, as described above. As a result, the welded portion 34 indicated by cross hatching and its proximate portions are rendered brittle. With such a conventional directly-heated cathode support structure as shown in FIG. 2, the strip lead 31 in heated across its full width during the welding process at the portion in contact with the support rod 2 so that if the opposing surfaces of the welding electrodes 51 and 52 are not exactly parallel to each other, especially in the axial direction of the support rod 2, a crack 35 may be formed in the edge of the strip lead 31. Therefore, with such a conventional support structure, the strip lead 31 may be broken in or in the vicinity of the welded portion 34 owing to a heat cycle due to flow of heating current during operation. This adversely affects the reliability.

SUMMARY OF THE INVENTION

The object of this invention is to provide a support structure for a directly-heated cathode, which is free from the above described drawback of the conventional cathode support structure, in which the mechanical strength of the welded portion between the strip lead of the directly-heated cathode and the support rod and its neighbouring portions is improved, and which therefore has a high reliability.

The feature of this invention is that the support rod is provided, at a suitable position for fixing the strip lead, with a protrusion having a top plane area which is contacted with the surface of the strip lead and through which resistance welding between the lead and the rod is effected. The length of the top plane area extending in the direction of the width of the strip lead is chosen to be 30–80% of the size of the width of the strip lead. Preferably, the peripheral length of the top plane area is chosen to be larger than the width of the strip lead.

DESCRIPTION OF THE PREFERRED EMBODIMENTS

Figure 1:
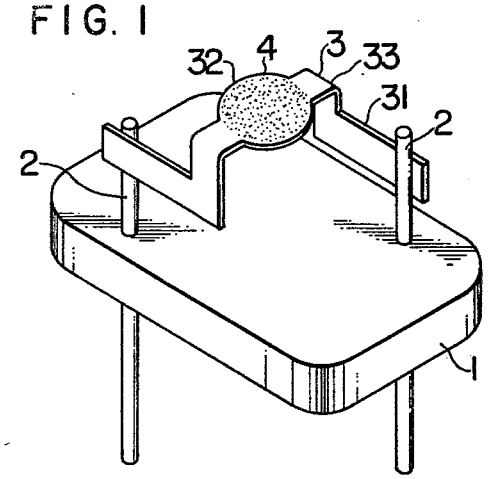
FIG. 1 perspectively shows a directly-heated cathode of a cathode ray tube and a conventional support structure for the cathode.
Figure 2:
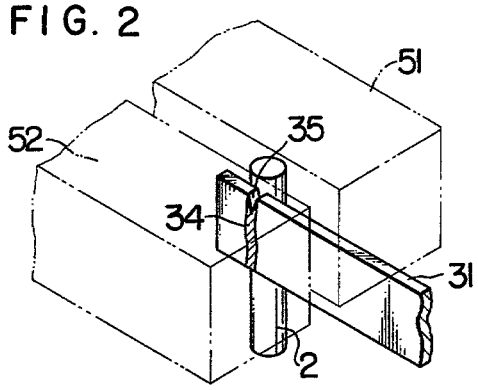
FIG. 2 shows the welded portion between the support rod and the strip lead, in the cathode support structure shown in FIG. 1.
Figure 3:
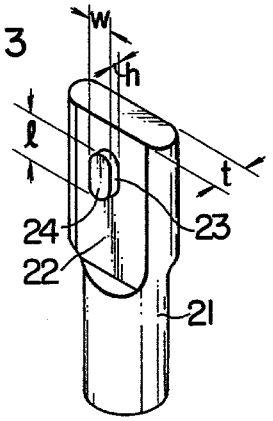
FIG. 3 perspectively shows a support rod used in a support structure according to an embodiment of this invention.
Figure 4:
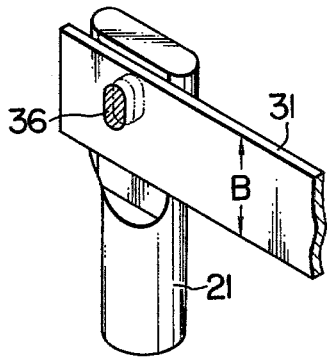
FIG. 4 perspectively shows the welded portion connecting the support rod as shown in FIG. 3 with the strip lead of the cathode.

FIG. 3 shows the welding portion of a support rod used in a directly-heated cathode support structure according to an embodiment of this invention. The support rod 21 has a flat portion 22 with a plane surface facing the surface of the strip lead 31 and a protrusion 23 with a top plane area 24. The rod 21 is made of relatively soft material such as Fe—Ni or Co—Ni—Fe alloy, and the protrusion 23 is formed by pressing one end of the rod 21, simultaneously with the formation of the flat portion having a thickness of t as shown in FIG. 3. The formation of the protrusion 23 can be easily performed by pressing the end of the rod 21 between a flat plate and a flat plate with a hole as a female counterpart of the protrusion 23. The length l of the protrusion 23 in the axial direction of the support rod 21, i.e. the extending length l of the top plane area 24 measured in the direction of the width of the strip lead 31, is chosen, as described above, to be about 30–80% of the width B (FIG. 4) of the strip lead 31. The reason why the maximum of l is determined to about 80% of the size of the width B is that the welded portion 36 is prevented from covering the full width of the strip lead 31, as shown in FIG. 4, so that there will arise no risk of forming a crack in the edge of the strip lead 31 as shown in FIG. 2, which may be formed in a brittle portion caused by welding. On the other hand, the reason why the minimum of l is about 30% of the size of the width B of the lead 31 is for avoiding difficulty in formation of the protrusion and for obtaining a desired welding strength.

The peripheral length of the top plane area 24 of the protrusion 23 is approximated to $(l+W)\times 2$, in FIG. 3. This peripheral length is made equal to or larger than the width B of the strip lead so as to obtain a welding strength not smaller than that obtained in the welding shown in FIG. 2. In the conventional case, as shown in FIG. 2, where the strip lead 31 is welded to the round rod 2, the welded portion 34 has a length equal to the width of the lead 31 and a small breadth formed around the contact line between the lead 31 and the rod 2 by deformation of them due to the pressure applied by the welding electrodes 51 and 52 and by melting due to the heat generated by the welding current. It is preferable in this invention that the effective area of the welded portion 36 is made not smaller than that of the welded portion in the conventional case. This leads to the requirement that the peripheral length of the top plane area 24 of the protrusion 23 should be greater than the width B of the strip lead 31. In practice, since the width B of the strip lead 31 is about 0.4–0.8 mm, the peripheral length is at least $(0.8B+0.8B\times\frac{1}{4})\times 2=2B$ if a protrusion having the length l equal to 80% of such a size of the width is to be formed. This is because it is impossible to form a protrusion whose width w is smaller than $\frac{1}{4}$ of the length l, by press techniques at the present. The height h of the protrusion 23 may be at least equal to the thickness of the strip lead 31, which is usually 0.03 mm. Actually, a strip lead with a width B of 0.65 mm was welded to a support rod with a protrusion having a length l of 0.45 mm, a width w of 0.30 mm and a height h of 0.05 mm. As a result, no crack was generated, and the cathode ray tube having a directly-heated cathode supported by the thus constructed support structure experienced no break of the lead in or in the vicinity of the welded portion after the cathode was subjected to a heat cycle in the actual operation of the tube, and thus high reliability was attained.

The technique in which one of the members to be welded together is provided with a protrusion and the welding is performed through the protrusion, is disclosed in, for example, the Japanese Patent Application Laid-Open No. 148,259/75. According to the disclosure, the main object of the provision of the protrusion is to obtain a desired welding strength. This invention applies a technique similar to that disclosed in the above Japanese Patent Application, to the structure for supporting a directly-heated cathode, by the object of the provision of the protrusion in this invention is not to obtain a desired wedling strength but to limit the welded area so that the welded area does not cross the full width of the strip lead.

Figure 5:
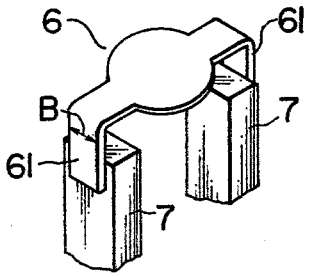
FIG. 5 shows another example of a support structure for the directly-heated cathode of a cathode ray tube.
Figure 6:
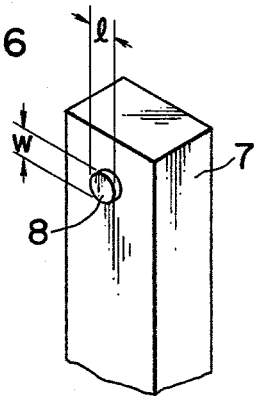
FIG. 6 shows a support rod used in a support structure according to another embodiment of this invention.

In the foregoing description, the support rod is considered to have a round cross section. However, the same effect can be obtained for a rod having a rectangular cross section only if the rod is provided with such a protrusion as proposed in this invention. Also, in the foregoing part of this specification, the description is made in connection with the construction in which the strip lead 31 is perpendicular to the support rod 21, that is, the direction of the width of the lead 31 coincides with the axial direction of the rod 21. However, a construction may be employed wherein the strip lead is disposed parallel to the support rod, that is, the direction of the width of the lead is perpendicular to the axial direction of the rod. In this case, if a round rod or a rod having a rectangular cross section with each of the sides of the rectangle shorter than the width of the strip lead, is used, the effect of this invention can not be expected since in this case the resulting welded area never covers the full width of the lead. However, if a rectangular rod 7, with the side of the cross-sectional rectangle, which is involved in the surface of the rod 7 to be contacted with the surface of a strip lead 61 of a directly-heated cathode 6, larger than the size of the width B of the lead 61 is used as shown in FIG. 5, the welded area spans the whole width of the strip lead 61 so that there is a risk of forming a crack in the edge of the strip lead 61 as described above. Accordingly, in such a case, the application of this invention is quite useful. Namely, by providing a support rod 7 with a protrusion 8, as shown in FIG. 6, and by welding the strip lead 61 to the support rod 7 through the protrusion 8, the formation of a crack is prevented so that the same effect as described above can be obtained. In this case, too, the dimensions l and w of the protrusion 8 is determined as described above.

As an alternative method of preventing the destruction of the support structure in or in the vicinity of the welded portion between the strip lead of the directly-heated cathode and the support rod, it may be proposed to provide the surface of one of the welding electrodes with a protrusion having a desired shape according to the shapes of the members to be welded together. In practice, however, since the width B of the strip lead is as small as 0.4–0.8 mm, the protrusion is at most 0.3–0.6 mm of the size corresponding to the length l so that these protrusions are too small to withstand the abrasion due to repeated welding operations. In addition, the positioning of the welded members in place with respect to the small protrusion will be difficult. This method is therefore not practical.

As described above, according to this invention, there is provided a structure for supporting a directly-heated cathode, with a high reliability, in which there is no risk of the strip lead breaking in or in the vicinity of the welded portion between the strip lead of the cathode and the support rod.

What we claim is:

1. A support structure for a directly-heated cathode of a cathode ray tube, comprising a base of insulating material and support rods which pierce said base and is rigidly fixed to said base and to which strip leads of said cathode are fixed through resistance welding, wherein said support rods are provided in their predetermined positions with respective protrusions having top plane areas which are to be contacted with the surface of said strip leads, the length of said top plane area extending in the direction of the width of said strip lead being 30–80% of the size of said width of said strip lead, and said strip leads are fixed to said support rods by welding said strip leads to said protrusions through resistance welding.

2. A support structure as claimed in claim 1, wherein the peripheral length of said top plane area of said protrusion is greater than the size of the width of said strip lead.

3. A support structure as claimed in claim 1 or 2, wherein said support rod has a flat surface facing the surface of said strip lead and said protrusion is provided on said flat surface.

* * * * *